US007591322B2

(12) United States Patent
Olson et al.

(10) Patent No.: US 7,591,322 B2
(45) Date of Patent: Sep. 22, 2009

(54) FIBER-OPTIC BASED AUTOMATIC FIRE-SUPPRESSION CONTROLLER

(76) Inventors: Mark Petrus Olson, 939 E. Bridge St., Plainwell, MI (US) 49080; Richard Lee Hilderbrandt, 15874 N. 400 St., Martinsville, IL (US) 62442

( * ) Notice: Subject to any disclaimer, the term of this patent is extended or adjusted under 35 U.S.C. 154(b) by 471 days.

(21) Appl. No.: 11/466,838

(22) Filed: Aug. 24, 2006

(65) Prior Publication Data

US 2008/0083545 A1 Apr. 10, 2008

Related U.S. Application Data

(63) Continuation of application No. 10/847,489, filed on May 17, 2004, now abandoned.

(51) Int. Cl.
*A62C 2/00* (2006.01)

(52) U.S. Cl. ..... 169/46; 169/60; 169/61

(58) Field of Classification Search ..... 169/16, 169/17, 37, 43, 45–47, 60, 61; 239/67–71
See application file for complete search history.

(56) References Cited

U.S. PATENT DOCUMENTS 4,159,744 A 7/1979 Monte et al.
4,227,577 A 10/1980 Iida
4,623,788 A 11/1986 Kern et al.
4,924,870 A 5/1990 Wlodarczyk et al.
6,044,913 A 4/2000 Stehling et al.
6,065,546 A * 5/2000 Uetake et al. ..... 169/61
6,111,511 A 8/2000 Sivathanu et al.
6,153,881 A 11/2000 Castleman
6,164,383 A 12/2000 Thomas
6,588,512 B2 * 7/2003 Sundholm ..... 169/5
2005/0252663 A1 11/2005 Olson et al.

* cited by examiner

*Primary Examiner*—Davis Hwu
(74) *Attorney, Agent, or Firm*—Price, Heneveld, Cooper, DeWitt & Litton LLP

(57) ABSTRACT

An electromechanical device utilizing a fiber-optic based sensor (fiber optic strand) for the purpose of detecting and extinguishing a fire momentarily after ignition. A light signal is transmitted through a loop of fiber optic strand that is used as a means to urge a spring loaded valve (firing valve) against its established position. The normally closed valve blocks the dispersal of a fire suppressing agent. This condition will persist until the strand is damaged by the presence of heat and open flame which is in close proximity.

6 Claims, 7 Drawing Sheets

FIBER-OPTIC BASED AUTOMATIC FIRE-SUPPRESSION CONTROLLER

CROSS-REFERENCE TO RELATED APPLICATIONS

This application is a continuation of U.S. patent application Ser. No. 10/847,489, filed on May 17, 2004, now abandoned entitled "Fiber-Optic Based Automatic Fire-Suppression Controller."

FIELD OF THE INVENTION

This invention relates to fire extinguishing systems and, more particularly, to fire extinguishing systems that do not require monitoring or operating personnel.

DESCRIPTION OF PRIOR ART

Fire extinguishers and fire-suppression systems are widely used in both residential and industrial constructions. The effort to halt or minimize the huge annual losses to life and property has been ongoing for decades. Both extinguishers and systems are numerous and varied. They range from simple hand-held units to vast built-in networks.

Many different types of fire extinguishing system designs are well known in the prior art. One innovation that has been used in the past is the incorporation of fiber optic cable as a sensor. The light transmission properties of fiber optic cable make it an ideal sensor. There are several prior art references utilizing fiber optic cable including, but not limited to, U.S. Pat. No. 6,044,913 to Stehling et al. (2000); U.S. Pat. No. 6,164,383 to Thomas (2000); U.S. Pat. No. 4,227,577 to Iida (1980); U.S. Pat. No. 4,159,744 to Monte et al. (1979); U.S. Pat. No. 6,153,881 to Castleman (2000); and U.S. Pat. No. 6,111,511 to Sivathanu et al. (2000) all of which are incorporated by reference in their entirety. Each of these examples makes use of the light transmission properties of fiber optic cable and each is designed to control a conventional extinguisher. By measuring either light intensity or frequency, these system designs seek to be more accurate in the detection of fire. These types of systems are fairly complex and are likely to be cost prohibitive to the general public.

A variant of these designs is described in U.S. Pat. No. 5,144,125 to Carter et al. (1992) which is also incorporated herein by reference. Another property of fiber optic cable is its susceptibility to heat damage. The light transmission property changes drastically as the cable is heated and then ultimately damaged. Carter et al. make use of this change to allow for the tracking of a fire's progress, primarily in the lower levels of ships. This design is also complex and does not lend itself to use by the general public.

In each of the aforementioned designs, there is a singular, glaring drawback: the general public has put none of these designs into use. The majority of annual loss to fire, be it to life or property, occurs in homes and businesses. The numerous disadvantages of these designs may well explain why this occurs. The aforementioned designs are, as a whole, fairly complex. This tends to make any one of them difficult and, therefore, expensive to manufacture. This, in turn, makes the finished product somewhat cost prohibitive to the general public. Furthermore, the more complex the system, the greater the odds of premature failure.

Additionally, light sensors utilized in a contaminated and somewhat hostile environment, such as cooking facilities, machining operations, and heating facilities require lens covers of some type to prevent damage. Contaminants will impair the sensor or cause false alarms without regular and dedicated maintenance. Light sensors must be aimed at a fire to detect it. A design requiring multiple sensors multiplies the aforementioned disadvantages one for one. Fire, by nature, can begin anywhere that heat, oxygen, and fuel exist together. Therefore, a single light sensor is severely limited and ineffective. Those designs that track the progress of fire through enclosed areas are of little use if they cannot act upon the fire where it exists.

Thus, the key to fire fighting is to attack and extinguish the fire as soon as it is detected. In order to incorporate this maxim with the tracking design, an elaborate and expensive computer system would need to be linked. Therefore, the need exists for a more simplistic fire extinguisher design which can be inexpensive to manufacture yet be highly effective in detecting and extinguishing fires in both a home and business.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

In the drawings, both a standard electronic schematic and simplified block diagrams are included.

Figure 1A:
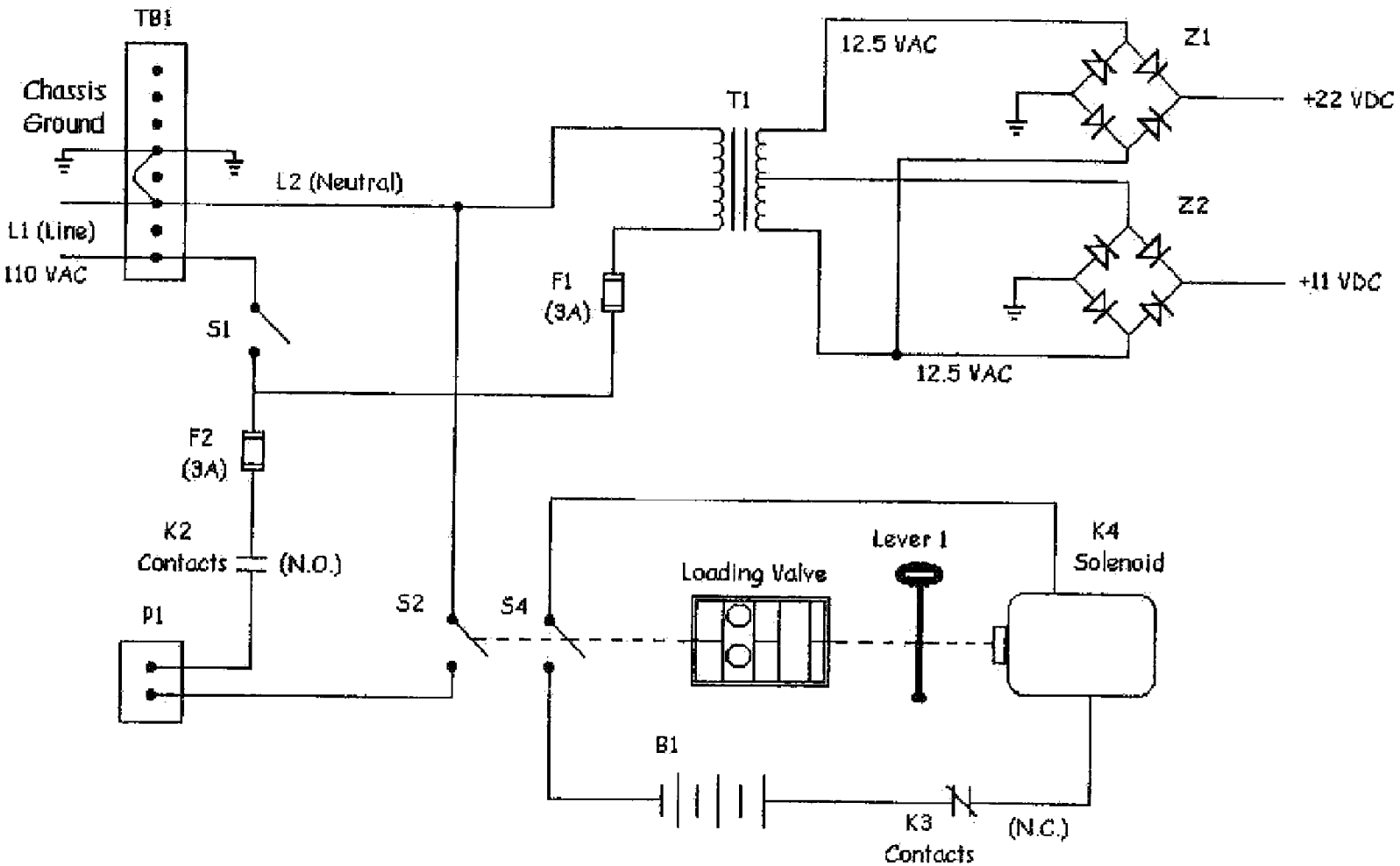
FIGS. 1*a* and 1*b* are block diagrams of the first section of the fiber-optic based fire-suppression controller according to an embodiment of the invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

Before describing in detail embodiments that are in accordance with the present invention, it should be observed that the embodiments reside primarily in combinations of method steps and apparatus components related to a fiber-optic based automatic fire-suppression controller. Accordingly, the apparatus components and method steps have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises . . . a" does not, without more constraints, preclude the existence of additional identical elements in the process, method, article, or apparatus that comprises the element.

It will be appreciated that embodiments of the invention described herein may be comprised of one or more conventional processors and unique stored program instructions that control the one or more processors to implement, in conjunction with certain non-processor circuits, some, most, or all of the functions of a fiber-optic based automatic fire-suppression controller described herein. The non-processor circuits may include, but are not limited to, a radio receiver, a radio transmitter, signal drivers, clock circuits, power source circuits, and user input devices. As such, these functions may be interpreted as steps of a method to perform a fiber-optic based automatic fire-suppression controller. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used. Thus, methods and means for these functions have been described herein. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

Figure 1B:
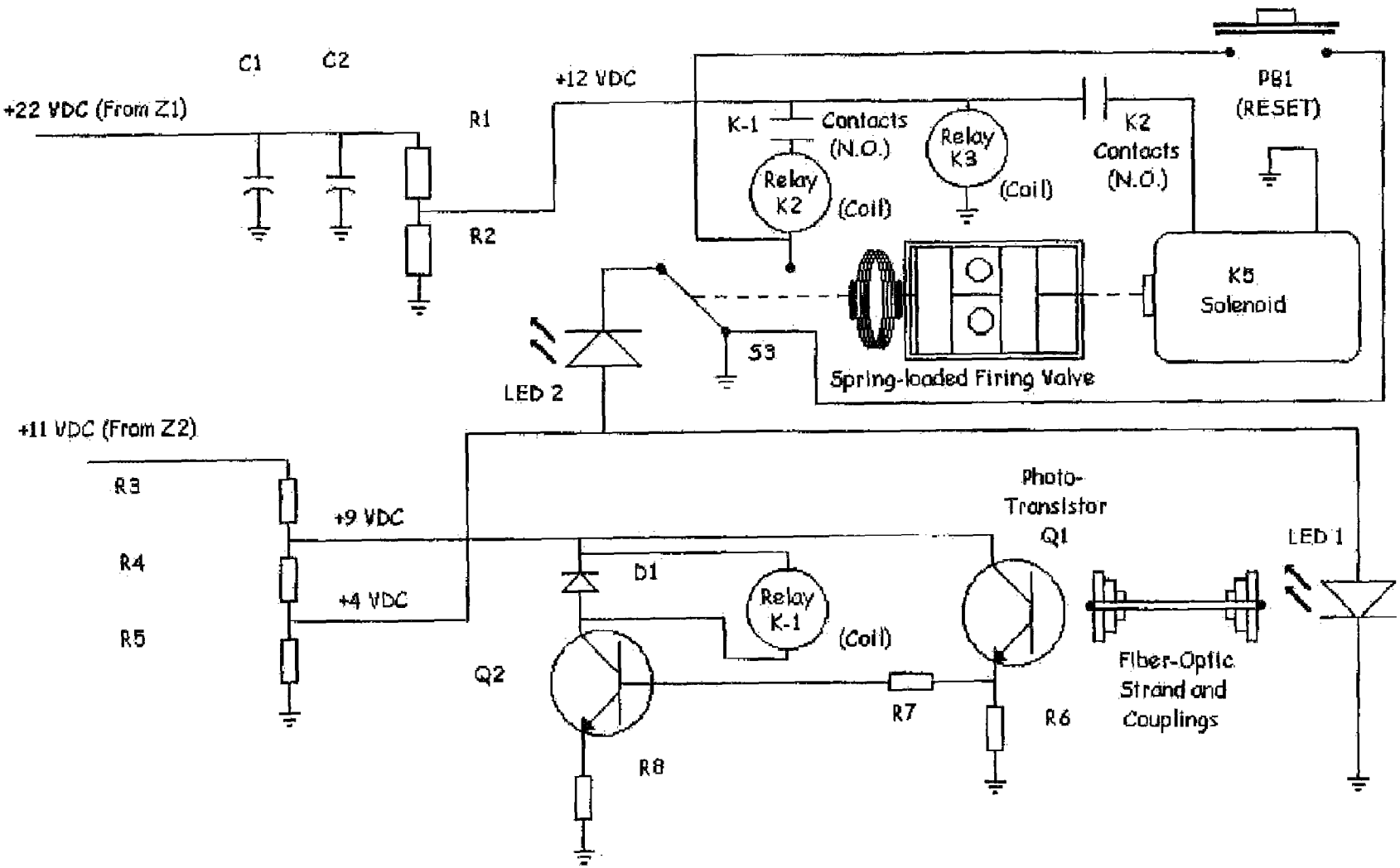

As the present invention is an electro-mechanical system, an embodiment is shown in FIGS. 1*a* and 1*b* illustrating a block diagram of the invention. Commercially available 110 volt alternating current (A/C) power is supplied to the system at a tie-board. The circuit uses 14 gauge, 2 conductor electrical cable with a ground. The system voltage can then be manually controlled by an externally mounted toggle switch. The internal circuitry provides the necessary power needed to operate a light source LED 1 and externally mounted phototransistor Q1. One end of a length of external unshielded fiber optic strand is centrally mounted directly in front of the light source LED 1. The opposite end of the external fiber optic strand is centrally mounted directly in front of photo transistor Q1. The sealed construction and unblemished terminations of these connections is such that contamination of the fiber optic strand is prevented. The fiber optic strand is then routed so as to be in close proximity to all anticipated fire sources. The fiber optic strand may be oriented in numerous configurations such as around pipes or through ductwork or framework.

Those skilled in the art will recognize that the optical fiber cable or strand is typically a plastic fiber that has the ability to guide light along its axis. Generally, there are at least three components to the optical fiber which include a core, cladding and a shield. The shield may also be referred to as a coating or buffer. In this application, the fiber optic multi-mode strand may be figured in a loop or multiple loop configuration which includes no shielding, coating or other protection over its entire length. When configured in this manner, the unshielded fiber optic loop acts as a detector so it can be more easily positioned to detect the presence of fire and its associated heat. The heat acts to rapidly damage the fiber optic strand before the room can become engulfed in flame. Since the optic fiber strand is unshielded over its entire length, it is completely vulnerable to the open flame and/or high temperatures generated by a fire in close proximity.

Figure 2:
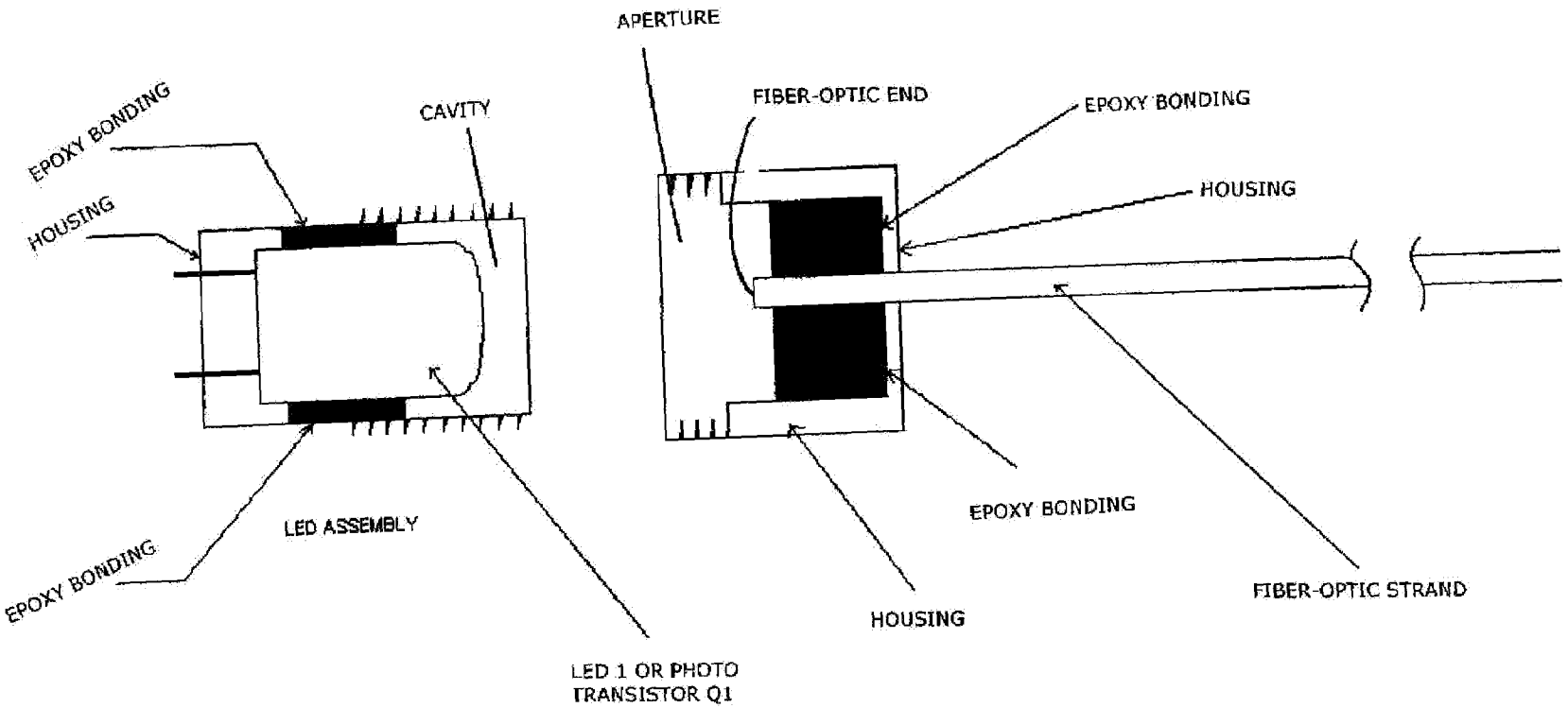
FIG. 2 is a block diagram illustrating an exploded view of the LED mounting assembly and the fiber optic strand coupling as shown in FIG. 1*b*.

FIG. 2 illustrates details of the mounting of the fiber optic strand. As seen in FIG. 1*b*, the fiber optic strand is positioned between the LED 1 and the phototransistor Q1. The LED assembly is used to house LED 1 and frictionally engages within an aperture located within the fiber-optic strand coupling. The LED assembly includes a housing that includes an internal cavity for housing LED 1. The LED may be either frictionally engaged within the cavity or secured using an epoxy material or other type of mechanical fastener. The LED's electrical connection projects from the rear of the housing so that it may be easily connected in the circuit topology as shown in FIG. 1*b* for powering the LED. Those skilled in the art will also recognize that the LED assembly may also be used in a similar fashion to house phototransistor Q1.

The fiber optic strand coupling is used to fasten each end of the fiber optic strand used in the detector with LED 1 with the phototransistor being attached at opposite ends. The fiber optic strand is positioned through a closed end of the fiber optic stand coupling so that it projects axially into the aperture formed in the coupling. The end of the fiber optic strand is positioned such that it is substantially flush with the rear end of the aperture and may be secured within the aperture using an epoxy material or other type of mechanical fastener. In operation, the LED assembly frictionally engages with the fiber optic strand coupling so that light from LED 1 is projected in the end of the fiber optic strand so it may propagate through the fiber optic material to the phototransistor Q1. Therefore, the orientation of LED 1 and phototransistor Q1 are important in relation to the end of the fiber optic strand so that light may be efficiently transferred to and from the fiber optic strand.

An externally supplied fire extinguishing medium is fed to the system at the inlet of the loading valve. The open position of the loading valve is manually selected by externally mounted lever 1 and can only be selected once the system is armed and ready to be activated. The closed position of the loading valve can be manually operated or controlled by the system. The internal circuitry is so configured so that (1), in the event of commercial power failure or (2), if the system is switched off, the internal battery provides power to force the loading valve closed. This configuration provides both a means of safely and cleanly changing extinguishing mediums and prevents erroneous firing of the system due to commercial power loss.

The firing valve provides the final control of the fire extinguishing medium. By spring loading the firing valve into the open position, then configuring the internal circuitry to pull and then hold the firing valve into the closed position, an "armed and ready to fire" condition is created. Only once this condition exists can the loading valve be moved to the open position, allowing the fire extinguishing medium to reach the inlet port of the firing valve. The system remains in this "armed and ready to fire" condition provided that: (1) no fire is present in the proximity of the fiber optic strand; (2) commercial power is uninterrupted; or (3) the system is not manually turned off.

If the above mentioned condition (1) changes, that being a fire occurs in the proximity of (and thereby destroying) the fiber optic strand, the firing valve opens and allows the fire extinguishing medium to reach externally mounted nozzles. The fire is thus directly attacked within seconds of ignition/detection.

If above mentioned conditions (2) or (3) change, the firing valve will also operate as above. However, the loading valve will operate as previously mentioned, closing instantly and preventing an erroneous firing.

Pushbutton is shown as an A/C power source to lights. Any single-phase A/C power device can be powered via the pushbutton. If any of the abovementioned conditions change, power is removed, thus preventing possible electrocution.

Additional embodiments are shown in FIGS. 2-5 which represent block diagrams illustrating various mechanical and/or electrical configurations of the present invention.

Figure 3:
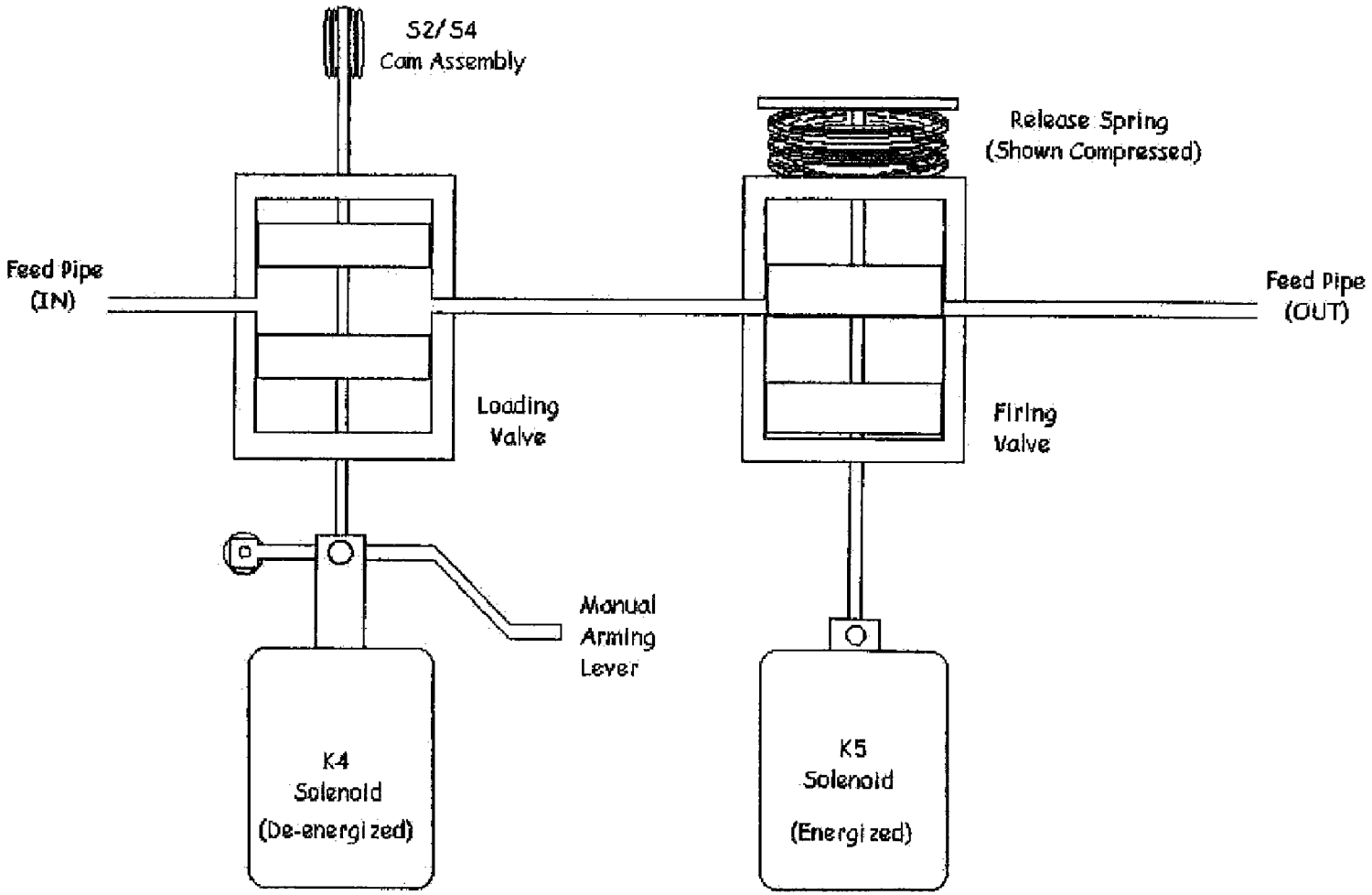
FIG. 3 is a block diagram of the mechanical arrangement of the loading valve and the firing valve.
Figure 4:
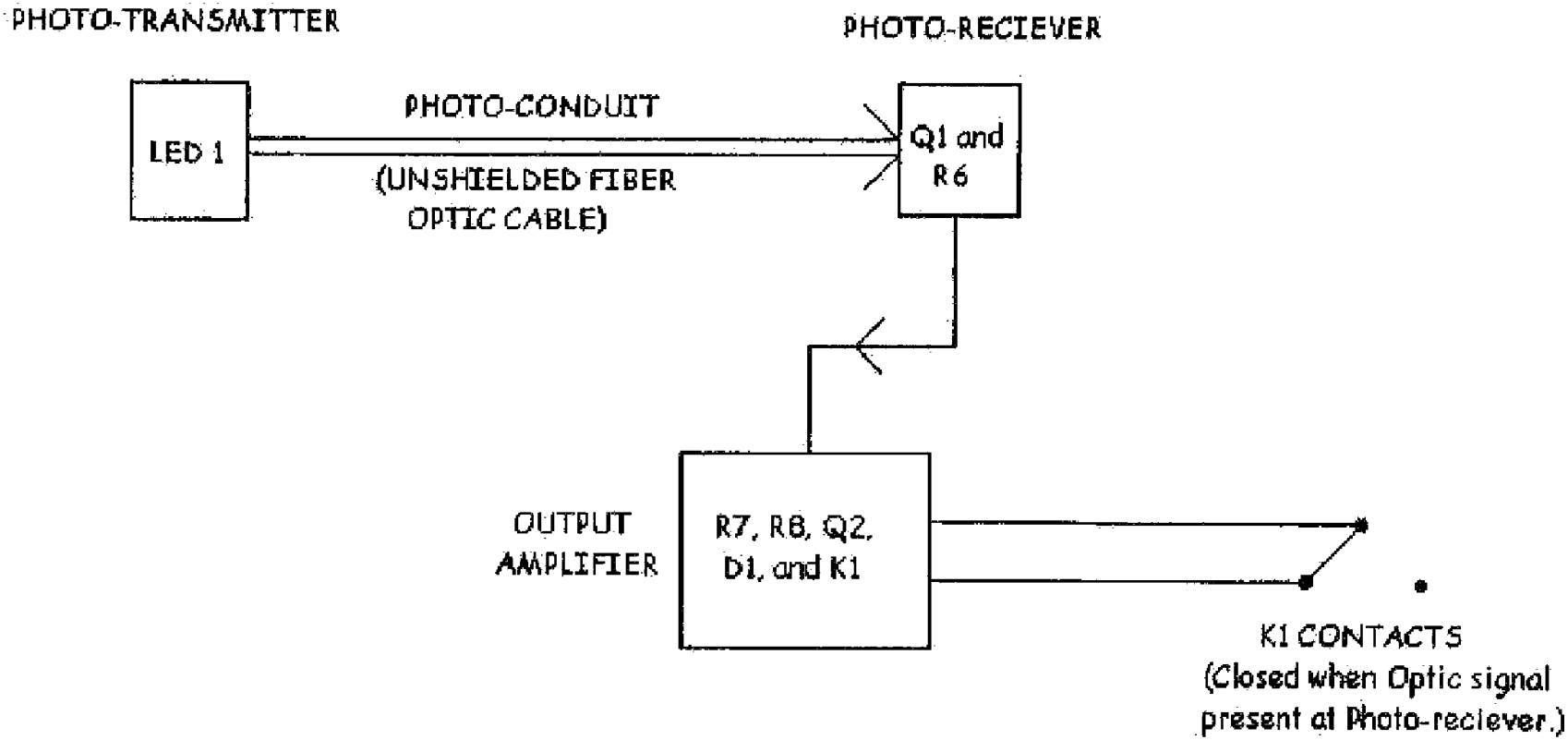
FIG. 4 is an electrical block diagram of the fiber optic sensor circuit.
Figure 5:
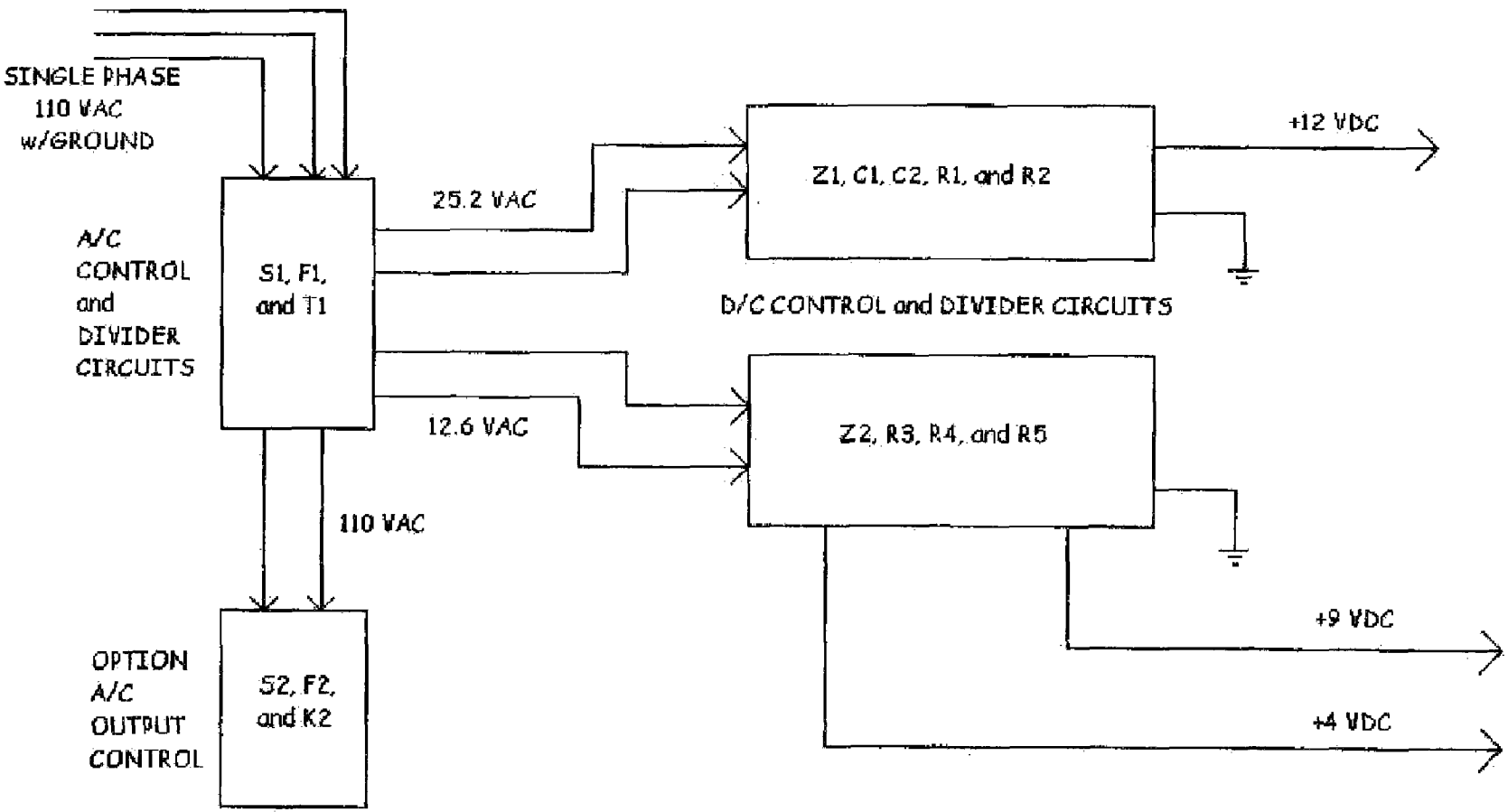
FIG. 5 is an electrical block diagram of the A/C and D/C power supplies.
Figure 6:
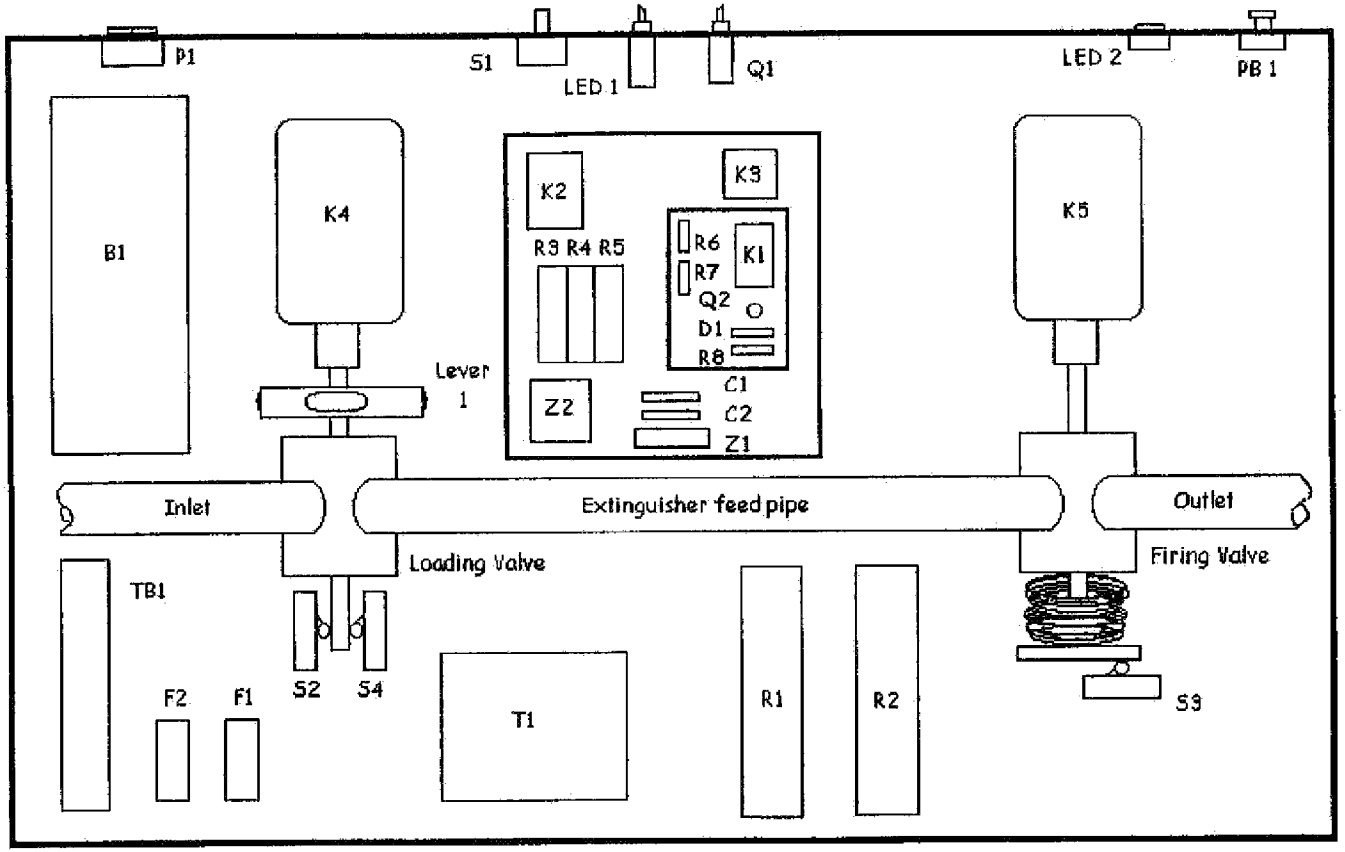
FIG. 6 is a diagram illustrating the physical layout of the working prototype.

FIG. 3 indicates the mechanical arrangement of both the loading valve and the firing valve including the electrical and mechanical positioning components. The figure indicates the "armed and ready to fire" condition. FIG. 4 indicates signal flow in the fiber optic sensor portion of the system. FIG. 5 indicates the system internal power supplies. Input and output voltages are noted as well as the related individual components. FIG. 6 indicates the component layout in the operational prototype.

Based upon the above description, several advantages of our controller are evident. The relative simplicity of the design allows for ease of manufacturability, therefore reducing finished good cost. Thus, our controller can be made readily available to the general public. The controller used in the present invention provides for ease of installation, operation, and maintenance. The controller may be installed virtually anywhere to provide total monitoring coverage while being relatively unobtrusive. The controller provides for unforeseen events such as commercial power failure or mishandling. The controller is unaffected by hostile environments or outside interference and can utilize virtually any extinguishing medium. Finally, the controller provides for immediate fire-suppression without monitoring equipment or personnel and has the capability to remove electrical power from nearby equipment, thus averting possible electrocution hazards.

With regard to the circuit's operation, single phase A/C power is applied to the controller at tie-board 1 at pins 1 and 3 with ground provided at pin 5. A/C neutral is applied directly to the primary side of tie-board 1 and the normally open contact of the single throw roller switch. A/C line voltage is routed to single throw, 120 VAC. Closing single throw, 120 VAC applies A/C line voltage to fuse 1 and fuse 2.

The A/C line voltage through fuse 1 is applied to primary side of center tapped transformer. Stepped down A/C voltage from the center tapped secondary is applied to solid state rectifiers and the appropriate respective rectifiers. Full secondary voltage (25.2 VAC) is applied to rectifier while one-half secondary voltage (12.6 VAC) is applied to rectifier. Rectifier converts secondary A/C voltage to +22 VDC. Filter capacitors C1 and C2 provide nominal filtering. A voltage divider consisting of resistor R1 and resistor R2 provide a standard relay drive voltage of +12 VDC. Rectifier Z1 converts secondary A/C voltage to +11 VDC.

A voltage divider consisting of resistor R3, resistor R4 and resistor R5 provide sensor circuit voltages of +9 VDC and +4 VDC.

The A/C line voltage through fuse F2 is applied to the normally open contacts of relay K2. The relay drive voltage is applied to the normally open contacts of relay K1 a second set of normally open contacts in relay K2, and the coil of relay K3. With DC power return (ground) hardwired to the coil of relay, the relay energizes, opening the normally closed contact in the loading valve circuit. This removes battery from the loading valve circuit. The loading valve can now be manually operated.

The +4 VDC sensor circuit voltage is applied to the anodes of both LED 1 and LED2. The cathode of LED 1 is hardwired to ground and so illuminates. The intense red light from LED 1 is transmitted through the fiber optic strand and returns to illuminate phototransistor. Ground to the cathode of LED2 is provided through the normally closed contact of single throw roller switch. LED2 is the visual indicator that the controller is disarmed or has been fired. The +9 VDC sensor circuit voltage is applied to the collector of phototransistor, across the cathode of diode, and to the coil of relay. Emitter bias for phototransistor is provided from ground through relay. Providing that the fiber optic strand is intact, red light or the like is transmitted to the base of phototransistor, causing the phototransistor to conduct.

The transistor, resistor and resistor comprise a current driver switched on by the conduction of phototransistor. The coil of relay is supplied a return to ground through the current driver circuit. Thus, as long as the fiber optic strand is intact, relay will be energized. The biasing voltage for transistor is set to a minimal value so that a small reduction in the amplitude of light received by transistor will cause the current driver circuit to switch off. Diode is configured across the coil of relay so as to prevent "chattering" or the failure to de-energize when power is removed.

When control relay is energized, +12 VDC is now applied through the closed contacts of relay to the coil of holding relay. Depressing pushbutton arms the controller. This reset button momentarily supplies ground to the coil of relay. Provided that the sensor circuits are receiving the light signal, relay will energize. Solenoid now is supplied with +12 VDC through the closed contacts of relay. Solenoid energizes and pulls the firing valve into the "armed and ready to fire" position (closed) switch is mechanically operated by the firing valve and will change states when the "armed and ready to fire" position is reached. Single-throw roller switch now provides ground to the coil of relay, which remains after the pushbutton or the like switch is released. Solenoid is now holding the firing valve against a compressed spring and will continue to do so, provided no interruption of the holding path created by relay, relay, relay and the +12 VDC power supply occurs.

With the relay now energized, the A/C line voltage is applied to plug. As the LED is now off, the operator may proceed to manually operate the loading valve into the open position with the attached lever. This allows the fire extinguishing medium to travel through the piping to the inlet side of the firing valve. There it is held under pressure unless the controller is fired. Its switches are mechanically operated by a cam physically attached to the loading valve. When the contacts of a single throw, roller switch are closed, the A/C neutral is supplied to plug. A complete single-phase A/C power supply is now provided to operate external equipment that will be shut down in the event of the controller firing.

When the contacts of single throw, roller switch are closed, part of the battery supply circuit to solenoid is completed. The circuit remains open so long as relay remains energized. In the event of commercial power failure, relay will de-energize, closing the normally closed contacts in the battery circuit. The solenoid now energizes, pulling the loading valve into the closed position, and thus shutting off the supply of fire extinguishing medium. The solenoid cam is so constructed that its switches remain closed until the loading valve is completely closed, at which time both sets of contacts will open. This both opens the battery power circuit to prevent battery drain and removes the A/C neutral leg from plug. As any interruption of the firing valve holding path will cause relay to de-energize, commercial power failure will cause the contacts of relay to open as well, removing the A/C line voltage from plug as well.

It can be determined, therefore, that the relatively simple design of the controller will allow for greater ease of manufacturability, thus reducing the finished good cost of the system, which will allow the general public access to purchase. Additionally, the flexibility of the controller allows for usage in multiple applications, thus broadening marketability and the scope of intended use. Furthermore, the simple design of the controller has the additional advantages in that rather than requiring highly trained service personnel, the layman can install and operate the controller with relative confidence. Repair can be easily effected in the event of damage or malfunction. It may be reused multiple times with minimal cost.

Although the description above contains many specificities, these should not be construed as limiting the scope of the invention but as merely providing illustrations of some of the presently preferred embodiments of this invention. For example, the controller can be configured so as to operate on storage batteries for portability, miniaturized for single-use applications, be sealed and pressurized for unusual environments, etc.

In summary, the present invention works to eliminate or lessen the impact of the aforementioned negatives through simplicity of design and use. The proposed device consists of a single closed loop of unshielded fiber optic strand, a photo cell assembly, and a pair of relay operated valves. There are several objects and advantages to the present invention which include providing a far simpler controller than those previously noted. The fiber-optic based fire-suppression controller (hereinafter referred to as "controller") lends itself to ease of manufacture and, therefore, a finished goods cost that allows the general public access to this technology. Moreover, the invention provides a fire system controller that is more reliable and is less subject to premature failure which is not subject to contamination by airborne particles, condensation, or mishandling. Finally, the controller acts to directly attack a fire the instant it is detected. It requires little or no maintenance and may be installed in a host of applications and can be so installed with relative ease.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

We claim:

1. A fiber-optic based fire extinguishing system utilizing a fire suppressant controller comprising:

at least one light emitting diode (LED) for providing a source of light;

at least one sensor body formed of a closed continuous loop of unshielded fiber optic strand;

at least one photo transistor for receiving the light through the at least one sensor body;

a first coupler assembly formed between the at least one LED and the fiber optic strand for efficiently transferring light from the LED into the fiber optic strand;

a second coupler assembly formed between the at least one photo transistor and the optic strand for efficiently transferring light from the optic strand to the at least one photo transistor; and wherein a spring load firing valve is triggered when the at least one photo transistor no longer receives light through the at least one sensor body.

2. A fiber-optic based fire extinguishing system as in claim 1, wherein the unshielded optic strand is composed of plastic optical fiber.

3. A fiber-optic based fire extinguishing system as in claim 1, wherein the at least one sensor body triggers dispersal of a fire suppressing agent when damaged.

4. A method for utilizing a fiber-optic based sensor in a fire extinguishing system comprising the steps of:

providing a light emitting diode (LED) emitting a source of light;

positioning a closed continuous loop of fiber optic strand in proximity to the LED for acting as a sensor;

positioning a photo transistor for receiving light through the sensor; forming a first removable coupling between the LED and the fiber optic strand; forming a second removable coupling between the fiber optic strand and the photo transistor;

including a first assembly with the first removable coupling and the second removable coupling that frictionally engages within a second assembly; and triggering a fire suppressing agent when the at least one photo transistor no longer receives light from the LED due to heat damage of the fiber optic.

5. A method for utilizing a fiber-optic based sensor as in claim 4, further comprising the step of:

actuating a spring-loaded firing valve using a solenoid-based switch when light is no longer received through the fiber optic strand.

6. A fire extinguishing system as in claim 4, wherein the optic strand is composed of plastic optical fiber.

* * * * *

UNITED STATES PATENT AND TRADEMARK OFFICE

CERTIFICATE OF CORRECTION

PATENT NO. : 7,591,322 B2
APPLICATION NO. : 11/466838
DATED : September 22, 2009
INVENTOR(S) : Olson et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 500 days.

Signed and Sealed this

Twenty-first Day of September, 2010

David J. Kappos

David J. Kappos
*Director of the United States Patent and Trademark Office*